United States Patent [19]

Fricker

[11] Patent Number: 4,571,912

[45] Date of Patent: Feb. 25, 1986

[54] OVERHEAD ANCHORING TRACK

[76] Inventor: Siegfried Fricker, Wurmberger Str. 30-34, 7135 Wiernsheim, Fed. Rep. of Germany

[21] Appl. No.: 707,512

[22] Filed: Mar. 4, 1985

[30] Foreign Application Priority Data

Mar. 2, 1984 [DE] Fed. Rep. of Germany ..... 3407801

[51] Int. Cl.[4] ..... E04B 1/38

[52] U.S. Cl. ..... 52/710; 52/365; 411/400

[58] Field of Search ..... 52/112, 365, 699, 700, 52/701, 707, 710; 411/84, 85, 396, 397, 398, 399, 400; 160/392

[56] References Cited

U.S. PATENT DOCUMENTS

| | | | |
|---|---|---|---|
| 992,877 | 5/1911 | Kahn | 52/707 |
| 1,155,243 | 9/1915 | Jordahl | 52/710 |
| 2,299,158 | 2/1941 | Luce | 411/84 |
| 3,208,409 | 9/1965 | Gale | 411/103 |
| 4,052,833 | 10/1977 | Beine | 52/710 |
| 4,396,326 | 8/1983 | McKinnie | 411/103 |
| 4,534,145 | 8/1985 | Yang | 52/222 |

FOREIGN PATENT DOCUMENTS

| | | | |
|---|---|---|---|
| 2534908 | 8/1977 | Fed. Rep. of Germany | 52/710 |
| 467589 | 3/1914 | France | 52/710 |

*Primary Examiner*—Henry E. Raduazo
*Assistant Examiner*—Dan W. Pedersen
*Attorney, Agent, or Firm*—Joseph A. Geiger

[57] ABSTRACT

An overhead anchoring track with a C-shaped channel and a row of outwardly protruding eye sockets in the web portion of the channel shape, the eye sockets having conical portions and adjoining neck portions which engage the threaded shaft portions of countersunk head anchoring screws, the anchoring screws having their heads supported in the conical portions of the eye sockets, on the inner side of the web portion, while being axially retained either by a female thread in the neck portions or by neck portions which are radially pinched against the screw shafts. At least one additional member is threadable onto the distal extremity of each anchoring screw, for the purpose of anchoring and/or positioning the anchoring track in relation to the concrete member.

11 Claims, 4 Drawing Figures

OVERHEAD ANCHORING TRACK

BACKGROUND OF THE INVENTION

1. Field of the Invention

The present invention relates to structural mounting components of the type which are embedded in cast concrete and, more particularly, to an overhead anchoring track which is designed to be embedded in a concrete ceiling member, for example.

2. Description of the Prior Art

Various overhead anchoring tracks of the type mentioned above are known from the prior art. These anchoring tracks normally consist of a C-shaped channel of rolled, bent or extruded metal with a plurality of anchoring members extending outwardly from the web portion of the channel. The channel profile includes short oppositely oriented leg portions on its open side, for engagement by the head of a suspension bolt of some other suspension member of a T-shaped outline.

The channel and the anchoring members are intended to be embedded in concrete in such a way that the open side of the channel faces away from the concrete member and the surface of the concrete member is flush with the outer side of the leg portions of the channel.

One such anchoring track is disclosed in the German Patent No. 26 31 396. This anchoring track uses anchoring members which have the form of short length portions of a rolled or extruded I-shape. One of the two flange portions of the I-shape is attached to a rectangular opening in the web portion of the channel, while the distal flange portion provides the anchoring engagement with the surrounding con- crete.

The rectangular openings in the channel web portion and the web of the I-shape are oriented in the longitudinal direction of the channel. The attached flange portion of the anchoring member includes a central protrusion which forms a head on the inner side of the channel. This head is formed from an upstanding central blade on the flange portion which, after insertion through the rectangular opening, is upset into a head shape in a riveting operation.

In an alternative mode of attachment, the rectangular opening in the web portion of the channel is wide enough to allow for the distal flange portion of the anchoring member to be introduced therethrough from the inside of the channel, while the attached flange portion is larger, so as to engage the web portion with lateral shoulders. An enlarged base portion of the I-shape near its attached flange is wide enough to fill out the rectangular opening and, being upset in a swaging operation, bulges laterally to attach the anchoring member to the web portion of the channel.

Among the shortcomings of this prior art solution are its cost, inasmuch as the anchoring elements are sawed-off or sheared off length portions of a specially shaped rolled or extruded I-shape, the rectangular openings in the channel require a special piercing and forming die, and the final attachment operation calls for an upsetting operation involving special tools and elevated forces.

As different sizes of anchoring tracks are needed for different applications, this means that a corresponding number of different sets of special tools and special I-shapes are required. A reduction in the number of different sizes of I-shapes can only be achieved by attaching oversized anchoring elements to some of the channel sizes.

The anchoring elements of this prior art solution are not adaptable to special requirements, such as reduced embedded depth. When it is necessary to connect the anchoring elements to other concrete reinforcing elements, such a load distributor plates, reinforcing rods, and the like, this can only be accomplished by welding special connecting members to the I-shapes.

Another prior art anchoring track is disclosed in the German Offenlegungsschrift (Published Application) No. 26 19 182. This publication teaches the use of regular head screws as part of the anchoring members, whereby nuts are welded to the outer side of the web portion of the channel, and the threaded shaft portion of each head screw engages the thread of one of the welded nuts.

In cases where the heads of these screws are not large enough to provide the necessary anchoring engagement with the surrounding concrete, load distributing plates or cross members must be welded to the screw heads.

This solution, while using inexpensive fasteners as anchoring members, requires a welding operation on the channel with entails the risk of distortion of the channel shape and the need for verification and/or corrective machining opera- tions.

Since the load-bearing connections between the anchoring elements and the anchoring track are constituted by the welds between the nuts and the web portion of the channel, these welds need to be verified carefully and machined, if necessary, thereby further increasing manufacturing costs.

SUMMARY OF THE INVENTION

Underlying the present invention is the primary objective of providing an improved overhead anchoring track which affords considerable savings in manufacturing costs by using commercially available anchoring elements which do not require any welding operations, while offering the safety of a predictable, consistently reliable load bearing connection between the anchoring elements and the web portion of the channel-shaped anchoring track.

The present invention proposes to attain this objective by suggesting an overhead anchoring track with a C-shaped channel as a main body and a row of openings in the web portion of the channel shape in the form of eye sockets with conical portions and adjoining neck portions with bores oriented perpendicularly to the longitudinal axis of the channel shape, whereby each neck portion engages the shaft portion of an anchoring screw adjacent to its head and the latter is arranged on the inner side of the web portion, so as to engage the conical portion of the eye socket, and at least one additional member is threadable onto the distal extremity of the anchoring screw, for the purpose of anchoring and/or positioning the anchoring track in relation to the concrete member.

In a preferred embodiment of the invention, the neck portion of the eye socket cooperates with the shaft portion of the anchoring screw in such a way that the latter is axially retained in the eye socket, either by means of a female thread in the bore of the neck portion, or as the result of the neck portion being radially pinched against the shaft portion of the anchoring screw. Alternatively, the anchoring screw may be axially retained by a counter-nut bearing against the outer face of the eye socket.

Since the distal extremity of the anchoring screw is the extremity of the threaded shaft portion of the anchoring screw, a variety of additional members can readily be threaded onto, or clamped to this extremity, for the purpose of anchoring and/or positioning the anchoring track in relation to the concrete member. These threadable or clampable members may, for example, take the form of a simple anchoring nut, a load-distributing anchoring plate, with or without a counter-nut, a threaded coupling sleeve, or a height-adjustable threaded positioning sleeve.

The invention further suggests the arrangement of two transverse reinforcing beads on longitudinally opposite sides of each eye socket, for additional stiffness of the web portion in the area of the eye socket. These reinforcing beads are preferably arcuate in outline and defined by sectors of a circle around the center of the eye socket.

The reinforcing beads are formed as depressions on the inner side of the web portion and corresponding ridges on its outer side, being obtained in the same die operation which pierces and shapes the eye sockets.

The anchoring members are regular countersunk head screws, their conical head fitting snugly into the conical portions of the eye sockets, for an optimal force transmission between the anchoring screw and the channel shape. The heads of the anchoring screws are flush with the inner wall of the channel shape, so as not to require an increase in the depth of the channel, as is the case with prior art anchoring tracks.

The anchoring track proposed by the present invention combines the advantages of low cost and ease of assembly with the advantages of improved rigidity of the web portion of the channel shape and versatility of the anchoring member in terms of the attachability thereto of a variety of anchoring and positioning members.

By proposing the use of commercially available fasteners as anchoring members, the anchoring track of the invention also eliminates the cost constraints imposed by the special anchoring members of the prior art on the number of different sizes of anchoring tacks which can be manufactured and stocked economically.

BRIEF DESCRIPTION OF THE DRAWINGS

Further special features and advantages of the invention will become apparent from the description following below, when taken together with the accompanying drawing which illustrates, by way of example, a preferred embodiment of the invention which is represented in the various figures as follows.

DESCRIPTION OF THE PREFERRED EMBODIMENT

Figure 1:
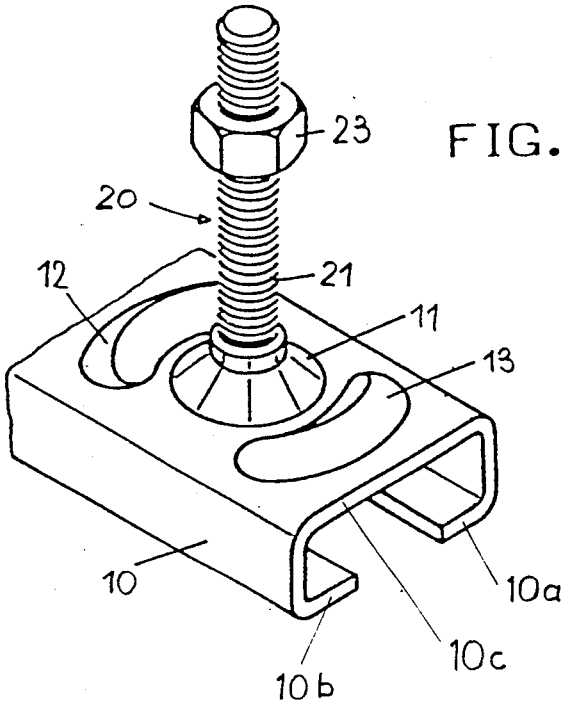
FIG. 1 shows, in a perspective view, a length portion of an overhead anchoring track with an attached anchoring element, representing an embodiment of the invention.
Figure 2:
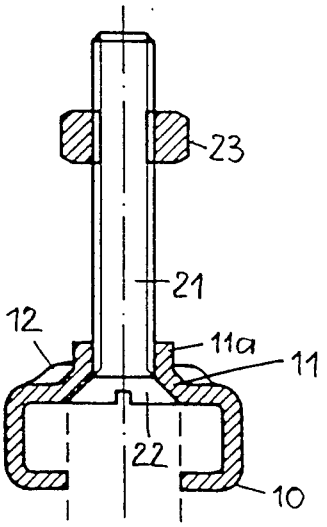
FIG. 2 shows the anchoring track of FIG. 1 in a transverse cross section.

The overhead anchoring track of the invention uses a channel 10 in the shape of a "C" formed of sheet metal stock. The channel shape 10 has on its lower, open side two oppositely extending leg portions 10*a* and 10*b*. The web portion 10*c* of the channel shape 10 has arranged along its longitudinal center line a number of eye sockets 11 of which one is shown in FIGS. 1 and 2.

The eye socket 11 is drawn and die-shaped from the wall of the web portion 10*c*, consisting of an outwardly recessed conical portion and an adjoining short cylindrical neck portion 11*a* which extends away from the back side of the web portion 10*c*. The conical portion of the eye socket 11 is shaped in such a way that its inner contour forms a seat for the head 22 of a countersunk head screw 20, as can be seen in FIG. 2.

The bore of the neck portion 11*a* may have a female thread, for engagement by the threaded shaft portion 21 of the screw 20. Alternatively, the neck bore may be a throughbore for the shaft portion 21, the screw 20 being secured to the eye socket 11 by means of a counter-nut (not shown).

In a preferred embodiment of the invention, the neck portion 11*a* is radially pinched against the threaded shaft portion 21, in an operation in which its diameter is reduced by means of an axially advancing hollow punch which is opposed by a die member supporting the head 22 of the screw 20. As a result, the threads of the shaft portion 21 are partially flattened and partially impressed into the bore of the neck portion 11*a*, for a firm attachment of the anchoring screw 20 to the eye socket 11 of the channel shape 10.

While the conical transition portion of the eye socket 11 assures a safe and evenly distributed load transfer from the head 22 of the screw 20 into the web portion 10*c* of the channel shape 10, the eye socket 11 serves to stiffen the web portion in this area.

An additional stiffening effect on the flat web portion 10*c* is achieved by means of two reinforcing beads 12 and 13 which are arranged on opposite longitudinal sides of the eye socket 11. The beads 12 and 13 are V-shaped ridges on the outer side of the web portions 10*c*, resulting from corresponding indentations which are impressed into the web portion 10*c* from its inner side, preferably in the same die operation in which the eye socket 11 is formed. The reinforcing beads 12 and 13 may have an arcuate outline, forming sectors of a circle around the eye socket 11.

The reinforcing beads 12 and 13 assist in the transmission of the load-induced vertical forces from the eye socket 11 in the center of the web portion 10*c* to the edges and side flanges of the channel shape 10 under minimal deflection of the web portion 10*c*.

This configuration, while effectively eliminating distortion-induced displacements of the embedded channel shape 10 under load, also minimizes any stress concentrations at the point of attachment of the anchoring element, as distinct from the earlier-described prior art solutions which use rectangular openings or welds as part of the attachment of the anchoring element and thereby weaken the web portion of the channel shape and/or produce points of high stress concentration.

Figure 4:
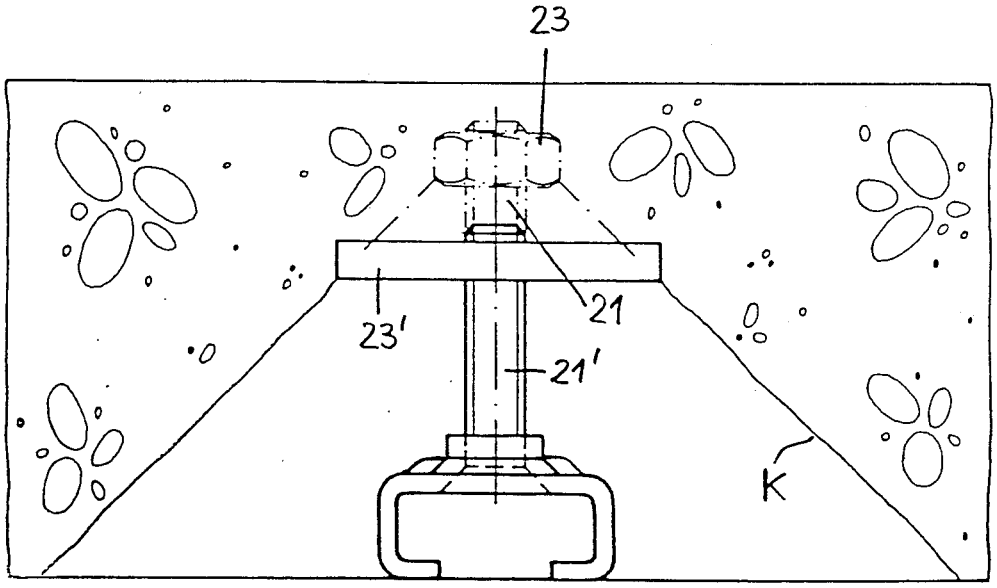
FIG. 4 shows the anchoring track of the invention with two different anchoring members, as embedded in a concrete ceiling member.

The distal extremity of the anchoring screw 20 may carry as a supporting member a simple nut 23, as shown in FIGS. 1 and 2, or it may carry an anchoring plate 23', as shown in FIG. 4. The anchoring plate 23' may have a threaded bore, with or without a counter-nut securing its position on the shaft portion 21 of the screw 20, or the anchoring plate 23' may simply have a throughbore and be secured on the shaft portion 21 by means of two nuts.

FIG. 4 shows that the use of a load-distributing plate in the form of the anchoring plate 23', for example, makes it possible to use an anchoring screw 20 with a shorter shaft portion 21', to obtain the same break-out cone K—indicative of the same load-carrying capacity of the embedded anchoring element—as compared to a longer shaft portion 21 and a nut 23 which are shown in stippled lines.

It will be readily understood, that the anchoring plate 23' could be replaced with any other desirable anchoring attachment which is suitable for connection to the shaft portion 21 of the screw 20. The latter thus lends itself conveniently to adaptation for the connection to any other members that may also be embedded in the concrete.

Figure 3:
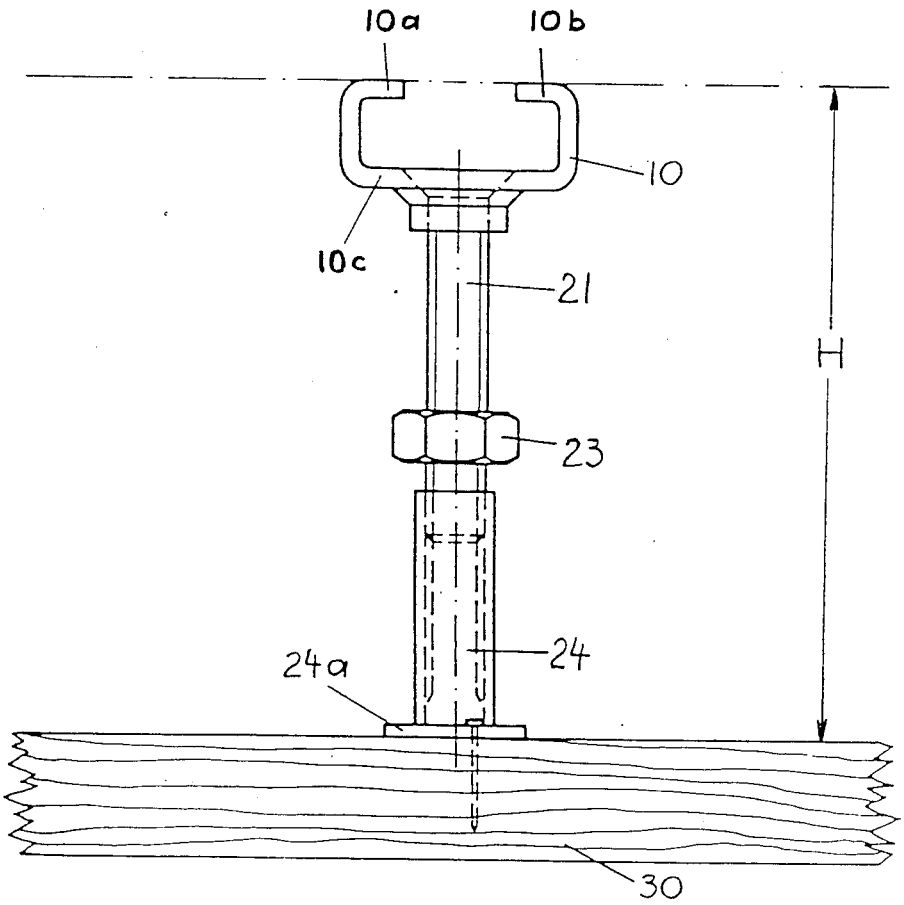
FIG. 3 shows the anchoring track of the invention in a position in which it is about to be embedded in cast concrete.

FIG. 3 shows a further advantage of the invention, inasmuch as the extremity of the threaded shaft portion 21 lends itself conveniently for engagement with the threaded bore of a positioning sleeve 24, for example. The positioning sleeve 24 serves to adjust the anchoring track to the desired height H from a form plank 30, following which the base 24*a* of the positioning sleeve 24 is secured to the form plank 30 by means of a nail, for example.

As an alternative to the positioning sleeve 24, it is also possible to use a threaded rod with the same thread as the shaft portion 21 and a suitable threaded coupling sleeve engaging both threads. Again, the threaded shaft portion 21 makes the anchoring screw 20 adaptable for connection to a large variety of positioning members.

It is to be understood that the invention is not limited in its application to the details of construction and arrangement of parts illustrated in the accompanying drawings, since the invention is capable of other embodiments and of being practiced or carried out in various ways. It is also to be understood that the phraseology or terminology employed herein is for the purpose of description and not of limitation.

I claim the following:

1. An anchoring track adapted to be embedded in the surface of a structural member of cast concrete, having a C-shaped channel as a main body with a row of openings in the web portion of the channel shape surrounded by recesses and an outwardly extending anchoring element connected to each opening, characterized in that the recesses are in the form of eye sockets (11) with a conical portion and an adjoining neck portion (11*a*) which have a bore oriented perpendicularly to the longitudinal axis of the channel shape (10), that each neck portion (11*a*) is adapted to engage the shaft portion (21) of an anchoring screw (20) adjacent to its head (22), and that the head (22) of the anchoring screw (20) is arranged on the inner side of the web portion (10*c*), so as to engage the conical portion of the eye socket (11), and at least one additional member is threadable onto the distal extremity of the anchoring screw (20), for the purpose of anchoring and/or positioning the anchoring track in relation to the structural member.

2. An anchoring track in accordance with claim 1, characterized in that the bore of the neck portion (11*a*) has a female thread which cooperates with the threaded shaft portion (21) of the anchoring screw (20) to axially retain the anchoring screw (20) in the eye socket (11).

3. An anchoring track in accordance with claim 1, characterized in that the bore of the neck portion (11*a*) is radially pinched against the shaft portion (21) of the anchoring screw (20) to axially retain the anchoring screw (20) in the eye socket (11).

4. An anchoring track in accordance with claim 1, characterized in that the threaded shaft portion (21) of the anchoring screw (20) carries a counter-nut to axially retain the anchoring screw (20) in the eye socket (11).

5. An anchoring track in accordance with claim 1, characterized in that the additional member which is threadable onto the distal extremity of the anchoring screw is a load-distributing anchoring plate (23').

6. An anchoring track in accordance with claim 1, characterized in that the additional member which is threadable onto the distal extremity of the anchoring screw is a load-carrying nut (23).

7. An anchoring track in accordance with claim 1, characterized in that the additional member which is threadable onto the distal extremity of the anchoring screw is a threaded coupling sleeve serving for the attachment to the anchoring screw (20) of a second member with a threaded shaft.

8. An anchoring track in accordance with claim 1, characterized in that the additional member which is threadable onto the distal extremity of the anchoring screw is an adjustable positioning sleeve (24).

9. An anchoring track in accordance with claim 1, characterized in that the web portion (10*c*) of the channel shape (10) includes, on longitudinally opposite sides of each eye socket (11), two transversely oriented reinforcing beads (12 and 13).

10. An anchoring track in accordance with claim 9, characterized in that the reinforcing beads (12 and 13) have an arcuate outline defined by two sectors of a circle around the center of the eye socket (11).

11. An anchoring track in accordance with claim 9, characterized in that the reinforcing beads (12 and 13) are in the form of depressions on the inner side of the web portion (10*c*) of the channel shape (10) and corresponding ridges on the outer side thereof.

* * * * *